US005927536A

United States Patent [19]

Oyagi et al.

[11] Patent Number: 5,927,536

[45] Date of Patent: Jul. 27, 1999

[54] METAL EASY OPEN CAN LID SUPERIOR IN CAN OPENABILITY AND PROCESS FOR PRODUCTION OF THEREOF

[75] Inventors: Yashichi Oyagi; Kouji Manabe; Hiroshi Nishida, all of Kitakyushu; Takehide Senuma, Futtsu; Hiroshi Itoh, Kitakyushu; Masaaki Yano, Futtsu; Tetsurou Takeshita, Kitayushu; Teruaki Izaki, Kitakyushu; Shinji Tanimoto, Kitakyushu, all of Japan

[73] Assignee: Nippon Steel Corporation, Tokyo, Japan

[21] Appl. No.: 08/894,113

[22] PCT Filed: Feb. 22, 1996

[86] PCT No.: PCT/JP96/00408

§ 371 Date: Aug. 12, 1997

§ 102(e) Date: Aug. 12, 1997

[87] PCT Pub. No.: WO96/26026

PCT Pub. Date: Aug. 29, 1996

[30] Foreign Application Priority Data

| | | | |
|---|---|---|---|
| Feb. 22, 1995 | [JP] | Japan | 7-033248 |
| Dec. 27, 1995 | [JP] | Japan | 7-341067 |
| Jan. 25, 1996 | [JP] | Japan | 8-010644 |

[51] Int. Cl.[6] ..... B65D 17/32; B21D 51/38

[52] U.S. Cl. ..... 220/266; 220/268; 220/269; 220/906; 413/15; 413/17

[58] Field of Search ..... 220/265, 266, 220/268, 269, 270, 276, 906; 413/9, 12, 14, 15, 16, 17, 19, 20, 58, 60, 61, 62, 67

[56] References Cited

U.S. PATENT DOCUMENTS

| | | | |
|---|---|---|---|
| 3,918,378 | 11/1975 | Clawson et al. | 413/17 |
| 3,939,787 | 2/1976 | Morrison et al. | 220/906 X |
| 3,949,692 | 4/1976 | DeLine et al. | 413/17 X |
| 3,969,919 | 7/1976 | Schrecker et al. | 413/17 X |
| 3,990,376 | 11/1976 | Schubert et al. | 413/17 X |
| 4,018,178 | 4/1977 | Klein et al. | 413/17 X |
| 4,154,184 | 5/1979 | Keller et al. | 413/17 |
| 4,244,315 | 1/1981 | Klein | 413/17 |
| 5,174,706 | 12/1992 | Taniuchi | 413/17 |
| 5,346,087 | 9/1994 | Klein | 220/269 X |
| 5,680,952 | 10/1997 | Chasteen | 220/906 X |

FOREIGN PATENT DOCUMENTS

| | | |
|---|---|---|
| 0443235 | 6/1991 | European Pat. Off. . |
| 56-117843 | 9/1981 | Japan . |
| 62-64441 | 3/1987 | Japan . |
| 63-12445 | 1/1988 | Japan . |
| 63-290636 | 11/1988 | Japan . |
| 6-170472 | 6/1994 | Japan . |

OTHER PUBLICATIONS

Supplementary European Search Report EP 96 90 3214 mailed Oct. 13, 1998.

*Primary Examiner*—Stephen K. Cronin
*Assistant Examiner*—Nathan Newhouse
*Attorney, Agent, or Firm*—Kenyon & Kenyon

[57] ABSTRACT

A metal easy open can lid, and a process for producing the same, wherein the can openability is improved and the occurrence of defects in the resin film at the time of shaping is eliminated whereby repair coating of the inner and outer surfaces are made unnecessary by making the cross-sectional shape of the opening guide groove of the easy open can lid an S-shape are provided, wherein, when forming the opening piece for easy manual opening in the metal lid, the properties of the resin film on the metal sheet, the shape and dimensions of the shoulder portions of the punch and die, the clearance, the residual thickness of the opening guide groove, the degree of the push-back processing, etc. are specified so as to achieve a superior can openability without breakage of the resin film by forming an opening guide groove with an S-shaped cross-section.

11 Claims, 13 Drawing Sheets

PUSHBACK PROCESSING

ECCENTRICITY: $P = \frac{L/2 - S}{L} \times 100\,(\%)$

METAL EASY OPEN CAN LID SUPERIOR IN CAN OPENABILITY AND PROCESS FOR PRODUCTION OF THEREOF

TECHNICAL FIELD

The present invention relates to a metal easy open can lid which can be used for beverage cans and other general food cans and a wide range of other applications and to a process for the production thereof, more specifically it relates to an easy open can lid, composed of a surface treated metal sheet consisting of a metal sheet such as a sheet steel, an aluminum sheet, or metal sheet which has been plated with tin or given surface treatment coating such as a chromate coating, paint, and resin laminate, provided with an opening guide capable of easy opening of part of the lid manually.

BACKGROUND ART

In the past, easy open can lids enabling manual opening of part of the container lid have been made by placing the lid body on a flat lower mold half and pressing a sharp blade having the required contour shape from the top surface so that the cutting edge bites into the lid body whereby the V-shaped cross-section tear-along groove shown in FIG. 6 is formed and the shape of the opening piece is obtained. With this method, however, since the cutting edge was sharp, the coating film provided in advance for prevention of corrosion would be broken, necessitating repair coating later in the case of a steel lid and thereby resulting in higher manufacturing costs.

One method which has been recently used to prevent corrosion in place of the conventional lacquer coating has been to use a thermoplastic resin film at some locations. A thermoplastic resin film has a relatively superior drawability, and therefore, possibly would enable processing of an opening piece without breaking it depending on the processing method used. When forming a V-shaped cross-section tear-along groove by the above sharp blade, however, it is not possible to completely avoid breakage of the resin film.

The easy open lid (or easy open end) used for beverage cans, general food cans, and the like may be roughly classified into two types: ones provided with a tab using the lever principle and ones without a tab which allow people to directly push and open the lid by finger pressure. The ones provided with tabs further may be broken down into ones where the opening piece comprising part or all of the container lid is torn off by the tab to separate from the can body, i.e., the tear off types, and ones where it is left attached to the can body, i.e., the stay-on tab types. Both types use a coated aluminum sheet or sheet steel as a material, punch them out into the basic lid shape, place them on a flat bottom mold half, press an upper mold half having a sharp edge cross-section scoring blade projecting from it in the shape of the contour of the opening, and form an opening groove of the shape of the opening in the material. To facilitate the opening of the can, it is necessary to press the scoring blade to a depth of the opening guide groove of ½ to ⅔ of the thickness of the sheet before processing. If the depth of the opening guide groove is too shallow, the openability will be poor, while if too deep, the strength will be insufficient and the can will open upon even a small impact from the outside.

When the materials of easy open can lids are made extremely thin due to demands for easy opening etc., a considerable precision has been sought in the scoring tools as well, resulting in an extremely short life of the tools. Due to this problem, as described in Japanese Unexamined Patent Publication (Kokai) No. 55-70434 and Japanese Unexamined Patent Publication (Kokai) No. 57-175034, measures have been devised for prolonging the tool life by forming a thin upward-facing connecting piece between the opening piece and its surroundings and then pressing down the opening piece to make the connecting piece bend in the middle and form the opening guide groove and thereby form a tear-off type opening piece for the can.

Further, due to the fact that, with the conventional processing of an opening guide groove, defects occur in an organic film layer and the metal surface becomes exposed, repair coating has been applied to ensure resistance to corrosion from the contents and prevent outside rust, but this repair coating also requires a complicated long baking process similar to that of the main coating work and further results in the discharge of a large amount of solvents contained in the coating, and therefore, due to environmental considerations, the discharged solvent must be incinerated in a special incinerator. In addition, since the heating during the baking of the coating and the incineration of the solvent result in the discharge of carbon dioxide, there were concerns of the load on the global environment.

Recently, as proposed in Japanese Unexamined Patent Publication (Kokai) No. 6-115548, Japanese Unexamined Patent Publication (Kokai) No. 6-115546, and Japanese Unexamined Patent Publication (Kokai) No. 6-122438, to eliminate the need for repair coating and to solve the above problems, a technique has been developed for producing an easy open can lid comprising of pressing a plastic laminated metal sheet by the shoulder radius of an upper and lower mold half to form the opening guide groove, but the openability of the can is not necessary sufficient.

Accordingly, we disclosed, in Japanese Unexamined Patent Publication (Kokai) No. 6-170472, conditions for producing a lid superior in openability limiting the shoulder radius of the upper and lower mold halves for forming the tear-along groove and the residual thickness of the tear-along groove portion after processing.

Further, the specification alluded to the fact that push-back processing reducing the step difference between the lid body and the opening portion was advantageous to the can openability. Just push-back processing alone, however, is not sufficient for achieving an improved can openability. In some cases, it causes breakage of the resin film. It has become clear that push-back processing suited to the state of processing of the guide groove of the opening portion is necessary. In particular, it has become clear that the relationship of the clearance between the die and the punch at the time of processing the opening portion, something not alluded to at all in Japanese Unexamined Patent Publication (Kokai) No. 6-170472, is important.

Further, it has become clear that it is possible to improve the can openability without breaking the surface resin film by the use of push-back processing which bends the metal into an S-shape after the pressing.

DISCLOSURE OF INVENTION

Accordingly, an object of the present invention is to eliminate the above problems in the prior art and to provide the processing conditions for an opening portion which maintain the corrosion resistance of the thin resin film bonded to the lid and which enable a good can openability to be secured.

Another object of the present invention is to further improve the can openability, that is, while the above pressing and S-shaped push-back processing enabled reduction of the thinness and formation of the bent portion without damage to the resin film of the surface of the metal sheet, giving, in the present invention, an S-shaped bent portion with peak points made the thinnest portions.

In accordance with the present invention, there is provided a process for producing a resin-coated can lid superior in can openability by processing an opening piece of a steel can lid having, on both sides, a resin film having a thickness of 10 to 100 μm and an elongation at break of at least 100%, comprising the steps of:

pressing the opening piece of the steel can lid such that the radii of a punch and die shoulder are made 0.1 to 1.6 mm, the clearance is made −1.6 to 0.3 mm, and a minimum thickness of a residual thickness of the tear-along groove portion in the opening piece is made of 15 to 100 μm, and then subjecting the opening piece to push-back processing for 0.3 to 1.5 times of the step difference amount formed between the lid body and the opening piece by pressing toward the lid body in the opposition direction as the above-mentioned pressing.

In accordance with the present invention, the above push-back processing may be performed by engaging a bead on the opening piece formed in advance and a recess portion of the push-back punch to keep the opening piece from shifting in the horizontal direction with respect to the punch.

In accordance with the present invention, there is further provided a sheet steel easy open can lid laminated with a thermoplastic resin superior in can openability formed by pressing and pushing back a sheet steel having at least on one surface corresponding to the inside surface of the can a saturated polyester resin film having a thickness of 10 to 100 μm and an elongation at break of at least 100% using the shoulders of upper and lower mold halves for forming tear-along grooves constituting the shape of the opening piece, having a thinnest portion of the processing having a cross-sectional shape of at least one peak point of the push-back processing, and having a thickness of the sheet steel at the thinnest portion of the processing of 15 to 100 μm.

In accordance with the present invention, there is further provided a sheet steel easy open can lid laminated with a thermoplastic resin superior in can openability wherein the resin film corresponding to the outside surface of the can is a polyamide resin having a thickness of 10 to 100 μm.

In accordance with the present invention, there is further provided a sheet steel easy open can lid laminated with a thermoplastic resin superior in can openability wherein the easy open can lid is either of the types where the can is opened by a tab separating part or all of the can lid and where the can is opened by a tab leaving part or all of the can lid on the can body.

In accordance with the present invention, there is further provided a sheet steel easy open can lid laminated with a thermoplastic resin superior in can openability wherein the easy open can lid is the type where the can is opened without a tab by an opening piece provided at one or more locations of the can lid leaving part of the opening piece at the can body or separating the opening piece from the can body.

Further, when the characteristic features of the present invention is explained, the cross-sectional shape of the opening guide groove obtained by pushing back the pressed portion is made an S-shape and at least one peak point of the S-shape is made the thinnest portion of the processing.

In accordance with the present invention, there is provided a process for production of a metal easy open can lid superior in can openability wherein, when pressing an opening piece of the metal easy open can lid, the pressing is performed such that the thinnest portion in the lateral cross-section of the processed portion displaces to either nonprocessed portion side by 3 to 40% of the length of the thinnest portion in the cross-section starting from the center of the thinnest portion and then pushback processing is performed so as to form a shape bent at the thinnest portion of processing.

In accordance with the present invention, for the above pressing, the punch and die shoulders are formed using part of an ellipse having a long radius of 0.1 to 5.0 mm and a short radius of 0.05 to 4.0 mm, the angle formed by the long radii of the ellipses of the punch and die is shifted 30 to 150 degrees, and the clearance between the two is made −3.0 to 0.5 times the short radius of the ellipse.

In accordance with the present invention, there is further provided a resin coated easy open can lid superior in can openability, and a process for production thereof, comprising, when pressing an opening piece of a metal easy open can lid having on at least one surface corresponding to the inside surface of the can, a coating or a resin film having a thickness of 10 to 100 μm and an elongation at break of at least 100%, pressing and then pushing back so that the thinnest portion in the lateral cross-section of the pressed portion displaces to either nonprocessed portion side 3 to 40% of the length of the thinnest portion starting from the center of the thinnest portion in the cross-section so as to form a shape bent at the thinnest portion of the processing.

In accordance with the present invention, for the above-mentioned pressing, the punch and die shoulders are formed using part of an ellipse having a long radius of 0.2 to 5.0 mm and a short radius of 0.1 to 4.0 mm, the angle formed by the long radii of the ellipses of the punch and die is shifted 30 to 150 degrees, and the clearance between the punch and the die is made −3.0 to 0 times the short radius of the ellipse.

BRIEF DESCRIPTION OF THE DRAWINGS

The present invention will be explained in further detail below with reference to the drawings, wherein.

BEST MODE FOR CARRYING OUT THE INVENTION

Figure 1:
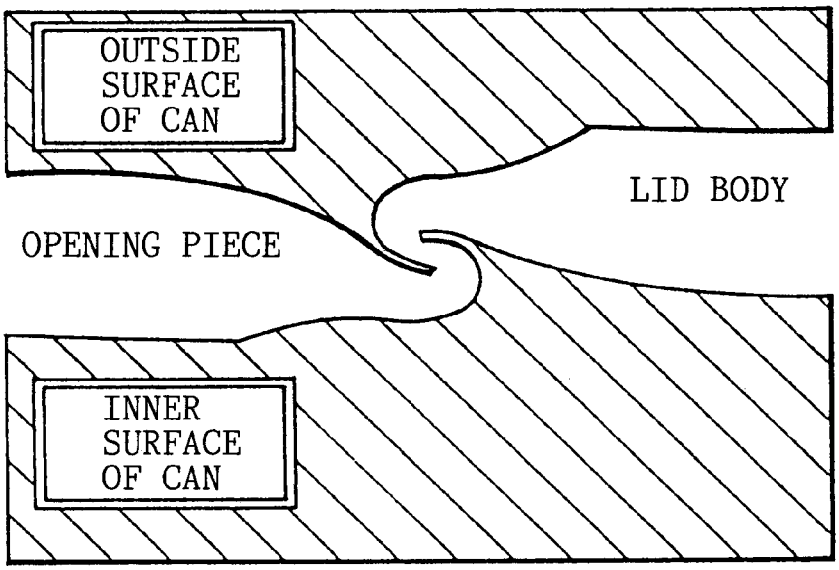
FIG. 1 is a view of the shape of the tear-along groove between the opening piece and the lid body after the push-back processing.

The present invention will now be described in further detail below.

The technical concept according to the first aspect of the present invention lies in the point of making the residual thickness of the tear-along groove thin without breaking the thin resin film and reprocessing the thinned portion so as to cause embrittlement and to obtain a shape where stress concentration occurs.

Therefore, for the resin for the resin film of the can lid, one is used which has a thickness of 10 to 100 $\mu$m, preferably 16 to 80 $\mu$m, and an elongation at break of at least 100%, preferably at least 150%. If the thickness is less than 10 $\mu$m, the coating will become too thin at the time of processing and may break, while if over 100 $\mu$m, it may not be able to follow the deformation and elongation of the sheet steel at the time of processing and may peel off. Further, if the elongation at break is less than 100%, again the coating may not be able to follow the deformation and elongation of the sheet steel at the time of processing and may break. The reason for making the thickness of the sheet steel at the thinnest portion 15 of processing after push-back processing 15 to 100 $\mu$m is that if less than 15 $\mu$m, the dropping strength of the easy open can lid cannot be secured and therefore the lid is not practical, while if over 100 $\mu$m, easy openability cannot be secured even at the peak point 16 of the S-shape of the thinnest portion 15.

As the method for achieving this, first, in the initial processing for forming the tear-along groove, contact of a sharp tool with the resin film is avoided and stress concentration is prevented from occurring in the stress distribution due to the processing. Regarding the former, it is necessary that the radii of the shoulders of the die and punch not be made too small. Further, if the radii are too large, a tremendous amount of force will be necessary for reducing the thickness of the tear-along groove and the risk will rise of the resin film breaking due to the compressive force. Accordingly, the radius at this portion is made 0.1 to 1.6 mm, preferably 0.2 to 1.0 mm. A systematic study was made of the methods for effectively reducing the thickness of the tear-along groove without breaking the resin film and, as a result, it was found that processing suitably combining compression, tension, and shearing was effective. This processing was achieved by limiting the clearance between the punch and die to −1.6 to 0.3 mm, preferably −1.0 to 0.0 mm.

If this clearance is less than −1.6 mm, then the compressive stress required for reducing the thickness will become too large, while if over 0.3 mm, the clearance will become too large and it will not be possible to reduce the thickness by compression and breakage will occur due to the tensile force.

Figure 2:
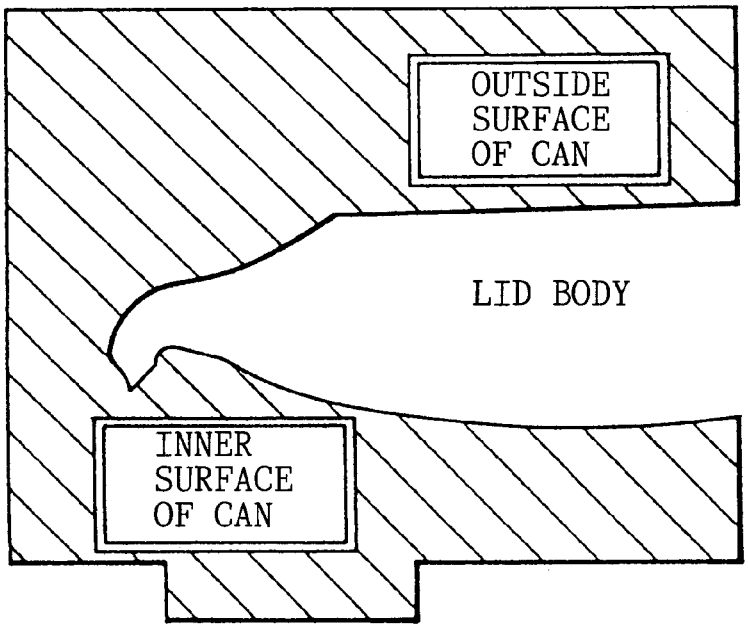
FIG. 2 is a view of the shape of the opening piece of the lid body after opening.

On the other hand, regarding the reprocessing of the tear-along groove thinned by the initial processing, it was found that suitable push-back processing was effective. Here, the characterizing feature is that by limiting the above clearance between the punch and die to the optimal conditions, the shape of the tear-along groove shown in FIG. 1 can be obtained after the push-back processing, stress concentration will occur at the tear-along groove portion at the time the can is opened, and the can will therefore be able to be easily opened. FIG. 2 shows the shape of the opening portion of the lid body after the can is opened. The torn portion faces downward so that there is almost no possibility of injury when one places one's mouth against it. If the amount of the push-back is too small, the necessary can openability cannot be obtained, so it is necessary that the amount of push-back processing be at least 0.3 time the step difference caused between the lid body and the opening piece due to the pressing. However, if too large, the risk rises of the opening portion breaking at the time of reprocessing, so it is made less than 1.5 times, preferably 0.6 to 1.3 times. Note that at 1.0 times, the lid body and the opening piece become the same in height. Further, at the time of push-back processing, the shape of the tear-along groove becomes stable and forms the shape shown in FIG. 2, so it is preferable to use the lead on the opening piece formed in advance and ensure that the scoring does not shift in the horizontal direction with respect to the punch.

An example of the processing of the can lid according to the first embodiment of the present invention will be explained below by the drawings.

Figure 3A:
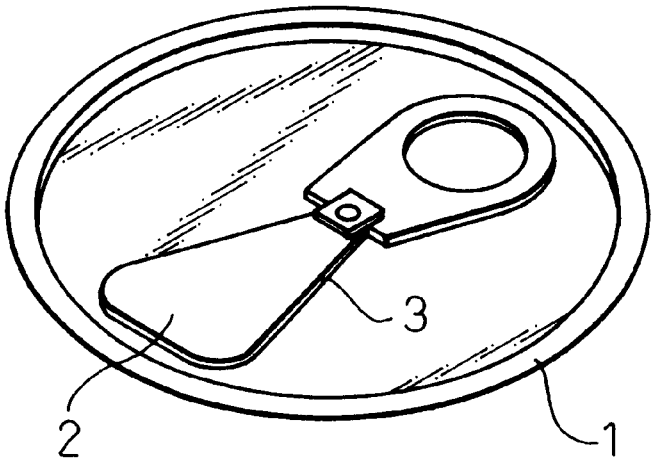
FIG. 3(A) and FIG. 3(B) are views of examples of the can lid after processing by the present invention.
Figure 3B:
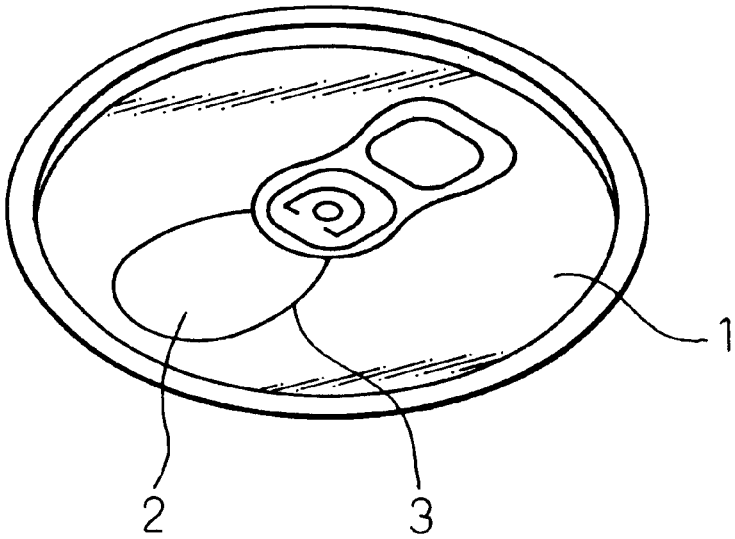

FIG. 3(A) and FIG. 3(B) show examples of the can lid after processing by the present invention. A tear-along groove 3 is formed between the lid body 1 and the opening piece 2.

Figure 4:
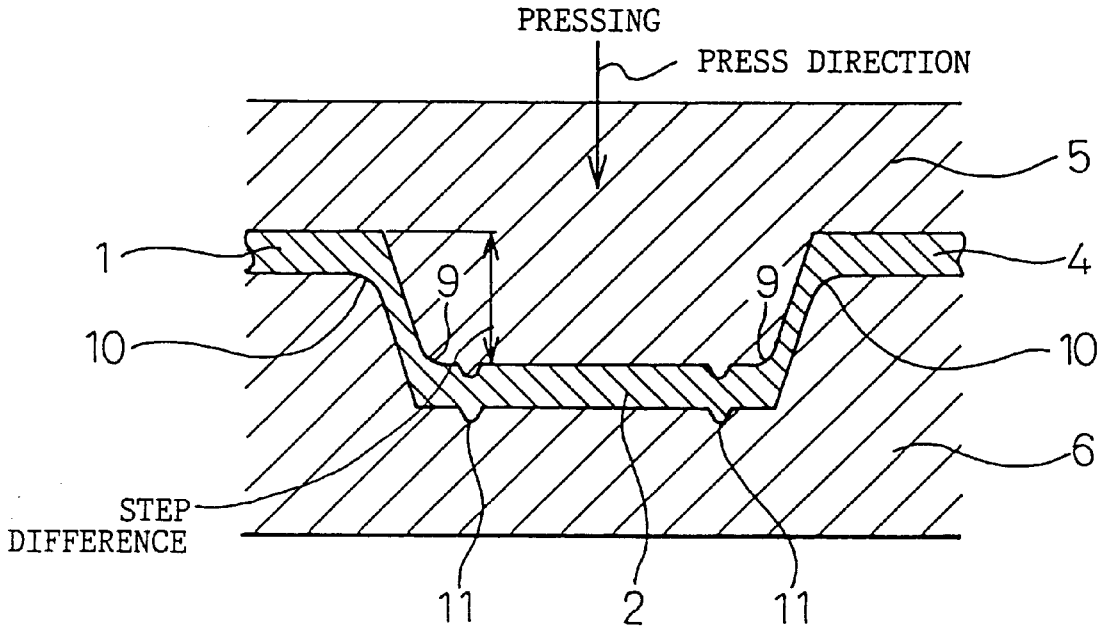
FIG. 4 is a view of an example of the pressing.

FIG. 4 shows an example of the pressing. The resin coated sheet steel 4 is sandwiched between one mold half A (punch) 5 and the other mold half B (die) 6 for the pressing. Here, the step difference t occurs between the lid body 1 and the opening piece 2.

Figure 5:
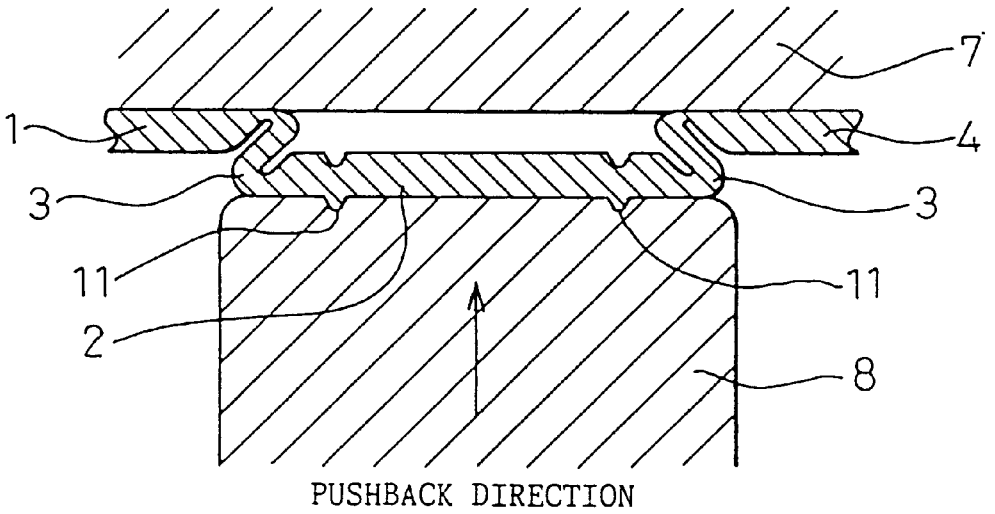
FIG. 5 is a view of an example of the push-back processing.
Figure 6:
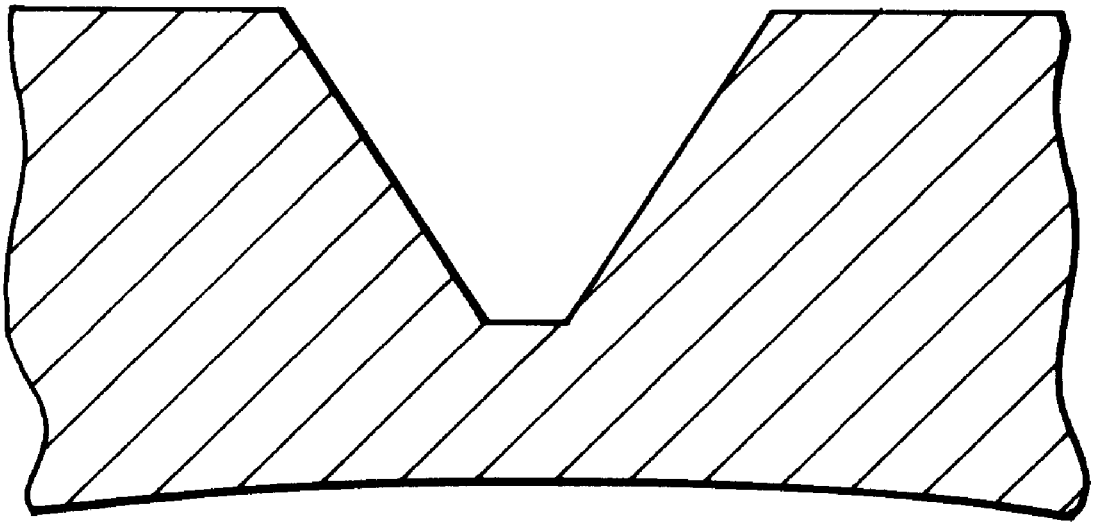
FIG. 6 is a view of a tear-along groove of a V-shaped cross-section obtained by the method of pressing down a sharp blade.

FIG. 5 is an example of the pushback processing. The opening piece 2 is pushed back by the push-back punch 8 from the corresponding side of the inside surface of the can to form the tear-along groove 3.

Here, regarding the type of the resin, basically if the above features are satisfied, specifically a polyethylene, polypropylene, polyester, polyamide, an ionomer, etc. may be used alone or in any mixture thereof. The type of the steel of the lid is not particularly limited.

A second embodiment of the present invention will be explained in detail below.

The sheet steel used in the present invention is normally one having mechanical properties of a thickness $t_0$ of 0.080 to 0.250 mm, a hardness ($H_{R30T}$) of 46 to 68, and an elongation of about 10 to 60%.

The surface of the sheet steel is plated by one or more metals of Sn, Cr, Ni, Al, or Zn. To eliminate the need for repair coating after the lid-making, a chromate treated coating is laminated with a resin film superior in bonding, processability, and corrosion resistance.

As the sheet steel specifically used, there are a tin-plated sheet steel giving tin-plating of 0.5 to 3.0 g/m$^2$ and then chemical treatment, a nickel plated steel sheet giving a nickel plating of 0.3 to 2.0 g/m$^2$ and then chemical treatment, an Sn/Ni plated sheet steel giving a Ni and then Sn plating of 0.5 to 2.0 g/m$^2$ and 0.01 to 0.5 g/m$^2$ of Sn and Ni deposition, respectively, then anodization, and a chrome-chromate treated sheet steel normally called TFS (i.e., Tin Free Steel) giving a metal Cr deposition of 50 to 200 mg/m$^2$ and a chrome oxide deposition of 5 to 30 mg/m$^2$.

The laminated resin on at least the can inside surface side of the above sheet steel is a saturated polyester resin film of a thickness of 10 to 100 $\mu$m and an elongation of at least 100%. This resin film follows the base material with good bonding at the time of processing of the tear-along groove by the pressing and is superior in processability as a coating itself, so completely covers the base material at the time of processing and does not require repair coating which had been needed in the past, and therefore, is an important presence.

The saturated polyester resin in the present invention means a linear thermoplastic polyester obtained by condensation polymerization of a dicarboxylic acid and diol and is best represented by polyethylene terephthalate. As the dicarboxylic acid component, there are terephthalic acid, isophthalic acid, phthalic acid, adipic acid, sebacic acid, azelaic acid, 2,6-naphthalene dicarboxylic acid, decane dicarboxylic acid, dodecane dicarboxylic acid, cyclohexane dicarboxylic acid, and the like alone or in any mixtures thereof. As the diol component, there are ethylene glycol, butadiene diol, decane diol, hexane diol, cyclohexane diol, neopentyl glycol, and the like alone or in any mixtures thereof. Copolymers of two or more dicarboxylic acid components or diol components or copolymers with diethylene glycol, triethylene glycol, and other monomers or polymers are also possible.

Further, the sheet metal resin film used in the present invention may optionally have blended therein additives such as plasticizer, antioxidant, thermal stabilizer, inorganic particles, pigment, organic lubricant. Further, when fastening the easy open can lid on a can body, the resin film will sometimes be shaved off and create a problem in work efficiency and appearance. From the viewpoint of the formation of the seam, the resin film on the outside surface is preferably a polyamide resin. The polyamide resin in the present invention means nylon 6, nylon 12, nylon 5, nylon 11, nylon 66, etc. alone or in any mixtures thereof.

The thickness of the resin film of the laminated sheet steel used in the present invention is made 10 to 100 $\mu$m, because, since the sheet steel and the resin film are both formed thinner due to the later mentioned pressing, if less than 10 $\mu$m, the barrier property (corrosion resistance and rust resistance) of the resin film at the processed portion in particular will not be able to be secured. If over 100 $\mu$m, the effect with respect to the barrier property of the resin film will be saturated which will be disadvantageous economically. When considering the stability of the performance, the economy, etc., a range of 16 to 80 $\mu$m is particularly effective. Further, the elongation at break of the resin film was limited to one over 100% because if less than 100%, the film would break due to the later mentioned pressing or push-back processing and a large number of defects would occur.

Note that the elongation characteristics of the laminated resin film were measured by peeling the resin film from the base material then using the method of JIS (Japanese Industrial Standard) C 2318.

Next, the processing method and shape will be explained.

In forming the opening portion, with the method of pressing using a sharp blade or shearing used in the prior art, repair coating after the shaping and breaking of the resin film becomes necessary so are not preferable.

Figure 8:
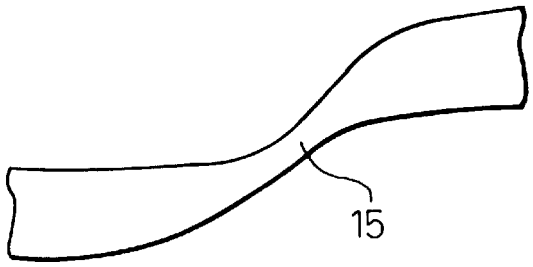
FIG. 8 is a sectional view of a tear-along groove formed by the pressing.
Figure 9A:
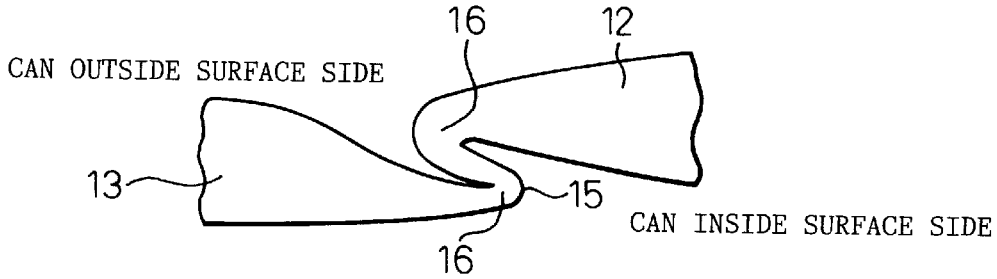
FIG. 9(A) and FIG. 9(B) are sectional views of the tear-along groove after the push-back processing of the present invention.
Figure 9B:
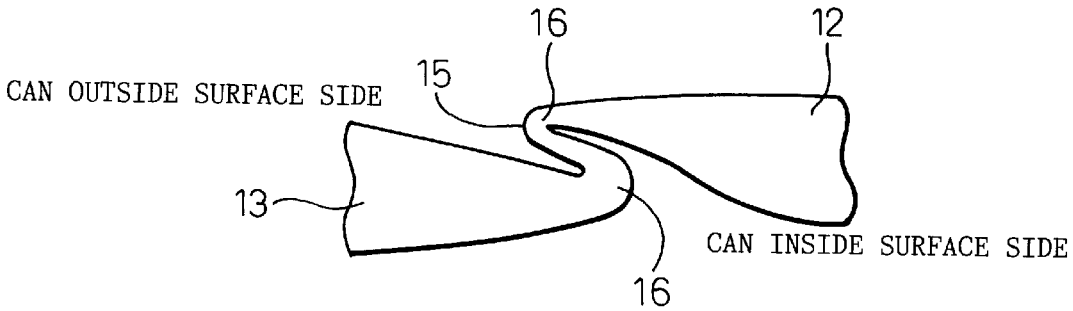

As a method of processing for forming a tear-along groove 14 without breaking the sheet steel and the resin film, upper and lower mold halves having shoulders having smooth are used, protruding curved surfaces at positions corresponding substantially to the shape and dimensions of the opening piece 13 and pressing the above-mentioned resin coated sheet steel. As shown in FIG. 8, a thin portion with a smooth change in thickness is formed, then push-back processing is performed to process the pressed portion into an S-shape as shown in FIG. 9(A) and FIG. 9(B). The push-back processing gives a thinnest portion 15 formed by the pressing as the peak point 16 of the S-shape. The thickness of the sheet steel at the processed thinnest portion 4 after the push-back processing is made 15 to 100 $\mu$m, but the thickness of the sheet steel can be adjusted mainly by pressing.

In the case of a pushbutton type with no tab, in the push-back processing after the pressing, the opening piece portion is processed to give a projecting button shape on the outside surface of the lid.

Here, the present inventors discovered that having the thinnest portion 15 positioned at the peak point 16 of the S-shape is an important point in obtaining an excellent can openability.

The reasons why the can openability can be improved by making the lid the above shape are believed to be as follows:

In the studies up until now, it was found that the breakage at the time of opening the easy open can having an opening guide groove of an S-shape formed by pressing and push-back processing occurred starting from the peak point portion of the S-shape. This is believed to be because the stress at the time of can opening concentrates at the peak point portion. Accordingly, by making the peak point portion where the stress when opening the can concentrates and becomes the actual starting point of the breakage the thinnest portion of the processing, it is believed that the can openability is further improved.

Note that the peak point referred to here will be explained next.

Figure 10:
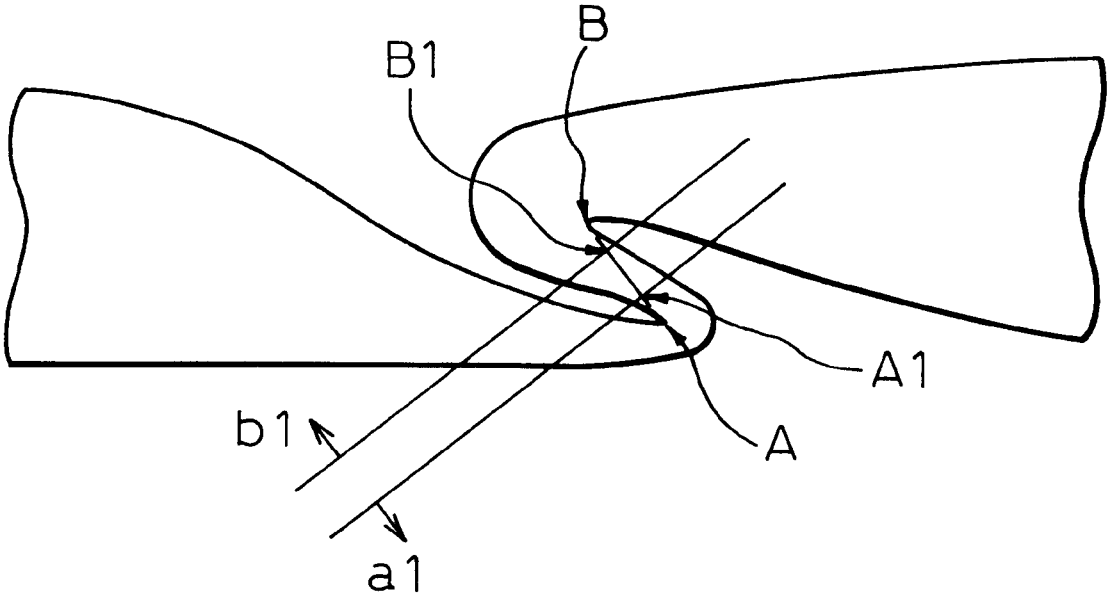
FIG. 10 is an explanatory view of the peak point of the push-back pressing of the present invention.

The deepest points of the curved portions formed by the push-back processing shown in FIG. 10 will be referred to as the point A and point B. Next, the position 30% of the length of the line segment A-B from the point A or the point B will be referred to as A1 or B1. The vertical to the line segment A-B passing through the point A1 is referred to as a1 and the vertical to the line segment A-B passing through the point B1 is referred to as b1. The portion receiving the bending at the point A side from the vertical a1 and the portion receiving the bending at the point B side from the vertical b1 are referred to as the peak points.

Figure 7A:
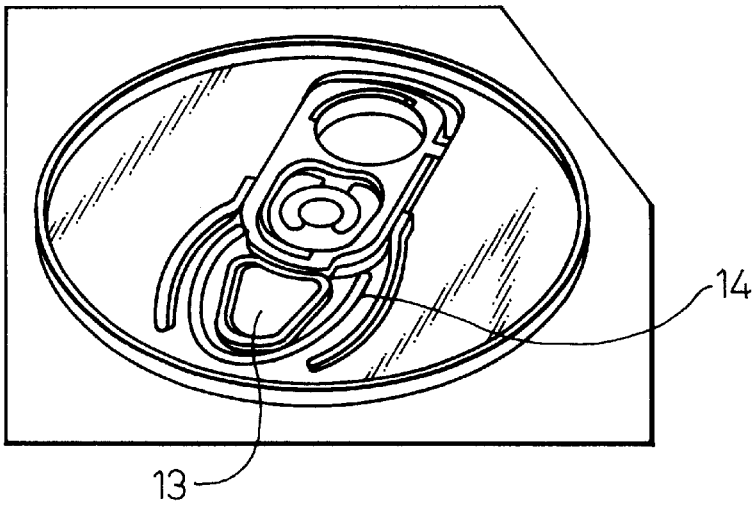
FIG. 7(A), FIG. 7(B), and FIG. 7(C) are views of easy open can lids formed by the present invention.

The reason why the thickness of the sheet steel of the thinnest portion 15 of the processing after the push-back processing was made 15 to 100 $\mu$m was that if less than 15 $\mu$m, the dropping strength of the easy open can lid cannot be secured and therefore, the lid cannot be practically used, while if over 100 $\mu$m, can openability cannot be secured even if the thinnest portion 15 becomes the peak point 16 of the S-shape. In the case of a stay-on tab type or partial pull-off type shown in FIG. 7(A), as represented best by the tab type, the thickness of the sheet steel of the thinnest portion of processing 15 after the push-back processing is preferably 35 to 65 $\mu$m.

Figure 7B:
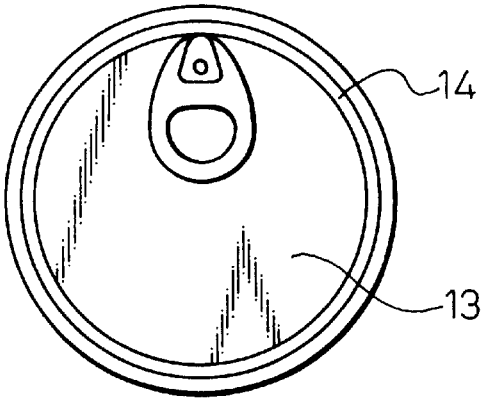
Figure 7C:
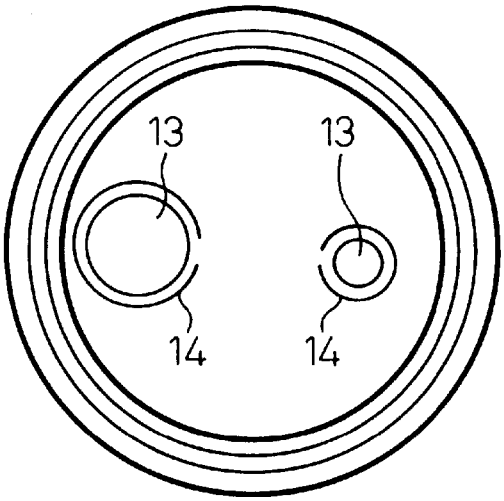

In the case of the pull-off type of pull-open end shown in FIG. 7(B), the can openability is improved from the standpoint of the shape, and therefore, the thickness of the sheet steel of the thinnest portion of the processing 15 after push-back processing is preferably 40 to 100 $\mu$m.

Further, compared with the tab type using the lever principle, in the case of the tab-less type, the thickness of the sheet steel of the thinnest portion of the processing 15 after the push-back processing is preferably made 25 to 50 $\mu$m from the standpoint of the easy openability.

In this series of processing steps, since the resin film having the above characteristics is elongated evenly together with the base material, no processing defects are caused, and therefore, there is no need for repair coating after the processing and an excellent corrosion resistance can be ensured. Further, according to the process of the present invention, since the processing is based on pressing or push-back processing or other pressing using the shoulder portions having mutually projecting smooth curved surfaces, there are almost none of the problems in tool life seen in the method of pressing a sharp blade, a superior productivity is ensured, and an easy open can lid is obtained.

Below, a detailed explanation will be made of a third embodiment of the present invention.

In the present invention, use is made of sheet steel or aluminum sheet or one of the same on whose surface is plated Sn, Ni, Cr, or Zn alone or together or one of these given anodization or one of these painted or laminated with a resin film. The resin film used is one with a thickness of 10 to 100 $\mu$m and an elongation at break of at least 100%. If the thickness is less than 10 $\mu$m, the coating becomes too thin at the time of processing and may break, while if over 100 $\mu$m, the coating will not be able to follow the deformation or elongation of the metal sheet at the time of processing and may peel off. Further, if the elongation at break is less than 100% the coating will again not be able to follow the deformation or elongation of the metal sheet at the time of processing and may break. An elongation of at least 150% is preferable.

Next, an explanation will be given of the processing shape.

Figure 20:
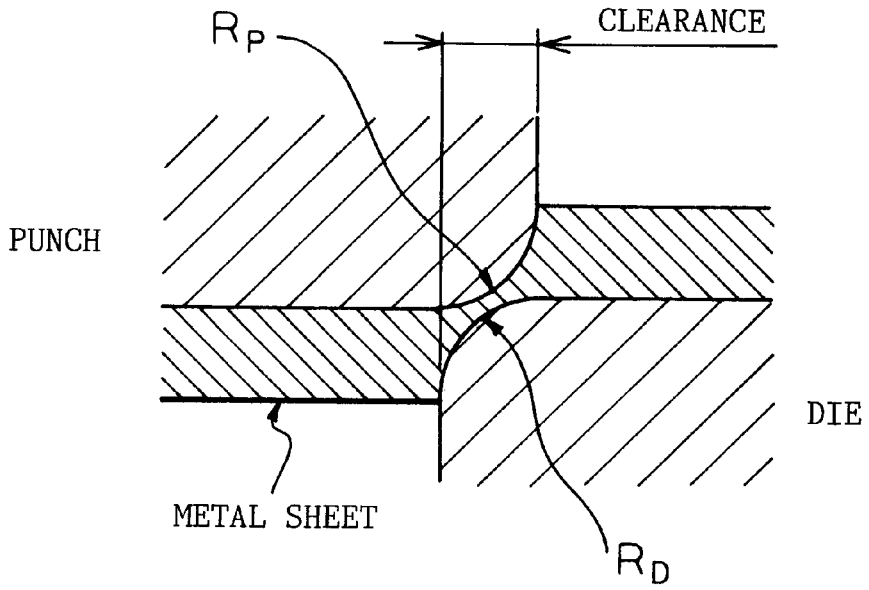
FIG. 20 is a view of a push-back mold chamfered in an arc and the processing shape.
Figure 21:
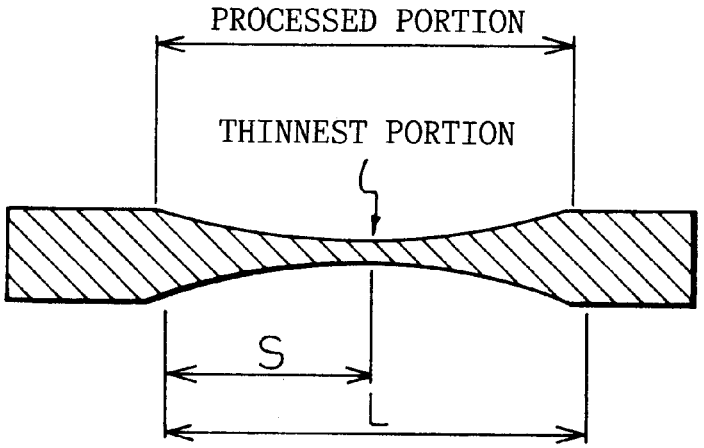
FIG. 21 is a view of a model of the residual thickness by the pressing.
Figure 22:
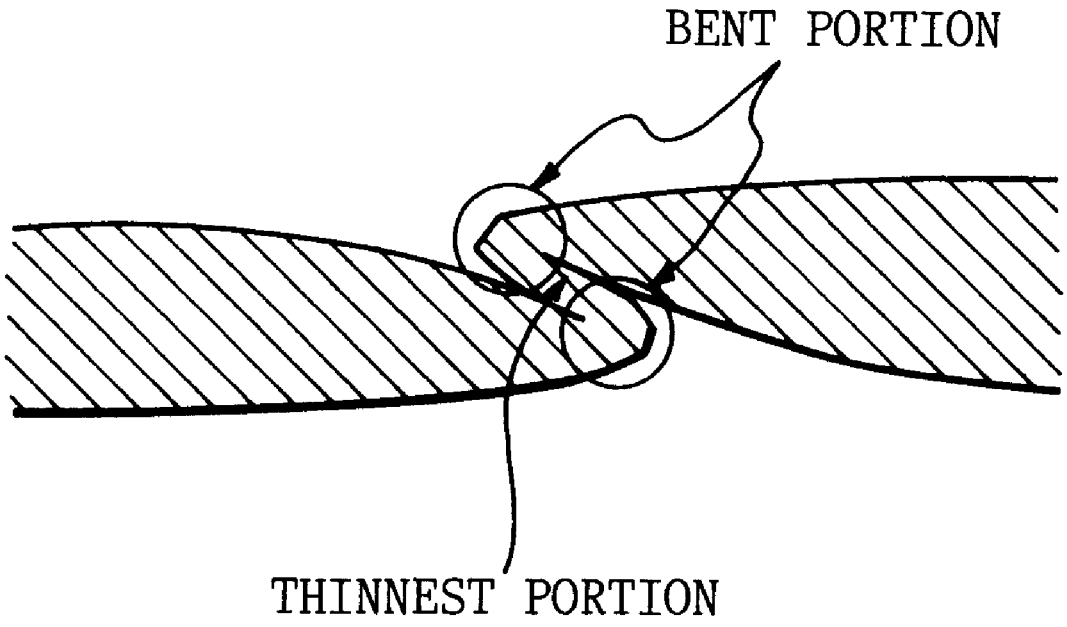
FIG. 22 is a sectional view of the push-back processing on a pressed material.

The above-mentioned method of thinning the metal sheet was one of performing the pressing setting the upper and lower mold halves, chamfered with the arcs of the radii of curvature $R_P$ and $R_D$ shown in FIG. 20, giving a certain clearance and pressing the metal sheet by the shoulder portions. FIG. 21 is a view of a model of the residual thickness of the sectional shape of the metal plate after the pressing. The thinnest portion with the smallest residual thickness is positioned at the center of the section of the processed portion (total length L) which has been thinned. When the push-back processing is then performed, as shown in FIG. 22, the thinnest portion becomes positioned between the two upper and lower bent portions resulting from the push-back processing.

Figure 11:
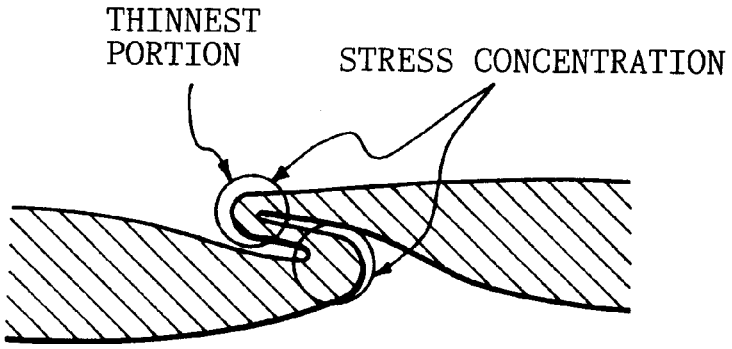
FIG. 11 is a sectional view of the ideal processing.
Figure 12:
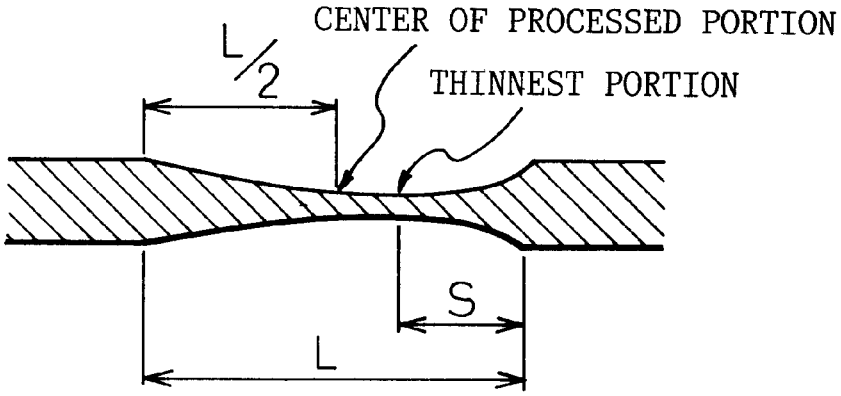
FIG. 12 is a view of a model of the residual thickness for the sectional shape sought after.

Therefore, by bending at the thinnest portion with the weakest strength of the material as shown in FIG. 11, the stress concentration is made to act at the thinnest portion and the can openability can be further improved. To obtain the shape of FIG. 11, it was discovered to make the residual thickness, which had had the distribution of FIG. 21 in the past, shift as shown in FIG. 12. That is, by pressing so that the thinnest sectional part displaced from the center of the processed portion (total length L) and then performing the push-back processing, it was discovered that the shape of FIG. 11 could be obtained. Here, the ratio of the shift of the thinnest portion from the center of the processed portion, that is, the eccentricity $\rho=\{(L/2)-s\}/L\times100(\%)$, is suitably 3 to 40%. This is because if $\rho$ is less than 3%, there is no effect of shifting the thinnest portion, while if over 40%, it is difficult to bend the metal at the thinnest portion and the shape of FIG. 11 ends up not being able to be obtained.

At this time, the minimum residual thickness after processing in the sheet steel is preferably 15 to 100 $\mu$m. This is because if less than 15 $\mu$m, the dropping strength of the easy open can lid cannot be secured and the lid cannot be used in practice, while if over 100 $\mu$m, the can openability is inferior. Further, in an aluminum sheet, the minimum residual thickness is preferably 40 to 200 $\mu$m. This is due to similar reasons as the sheet steel, but it is preferable to select the above value in consideration of the difference in material strength.

Next, an explanation will be made of the processing method.

Figure 13:
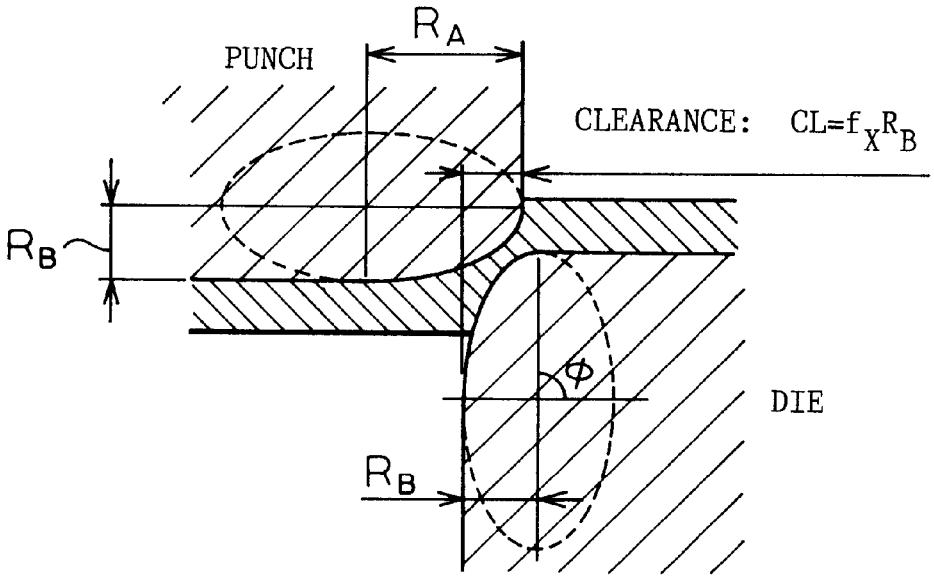
FIG. 13 is a view of the pressing mold using the elliptical shape and the processing shape.

In the pressing using molds chamfered by arcs shown in FIG. 20, the distribution of the residual thickness becomes symmetrical about the left and right as shown in FIG. 21. Here, to obtain the distribution with the eccentric residual thickness as shown in FIG. 12, processing is performed using part of the ellipse for the shape of the shoulder portion of the pressing molds as shown in FIG. 13. Further, as further shown in FIG. 13, this is characterized by forming the shoulder portions of the molds by making the angle formed by the long radial axes of the punch and the die, that is, $\phi$=30 to 150 degrees. This is because in the case where the flat directions of the ellipses are the same (0 degree$\leqq\phi<$30 degrees, 150 degrees$\leqq\phi<$180 degrees), the distributions of residual thickness become symmetrical and the eccentric distribution shown in FIG. 12 cannot be obtained. Normally, as shown in FIG. 13, they are set at $\phi$=90 degrees.

Here, to cause the eccentric distribution of residual thickness shown in FIG. 12, the larger the ratio $R_A/R_B$ of the long radius and the short radius the better, but if the value is large, the ellipse becomes pointed in shape, so with a resin coated sheet steel, it is believed that the resin film on the surface of the sheet will be damaged by the sharp end at the time of processing, so $1.5<R_A/R_B<3$ is preferred.

Figure 14:
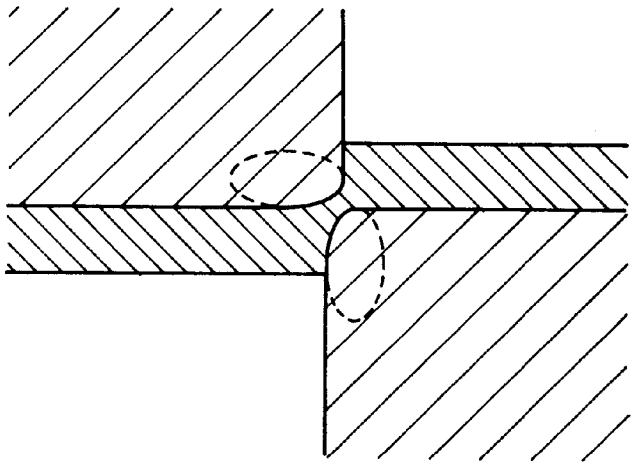
FIG. 14 is a view of the case where the radius of curvature of the ellipse is small.
Figure 15:
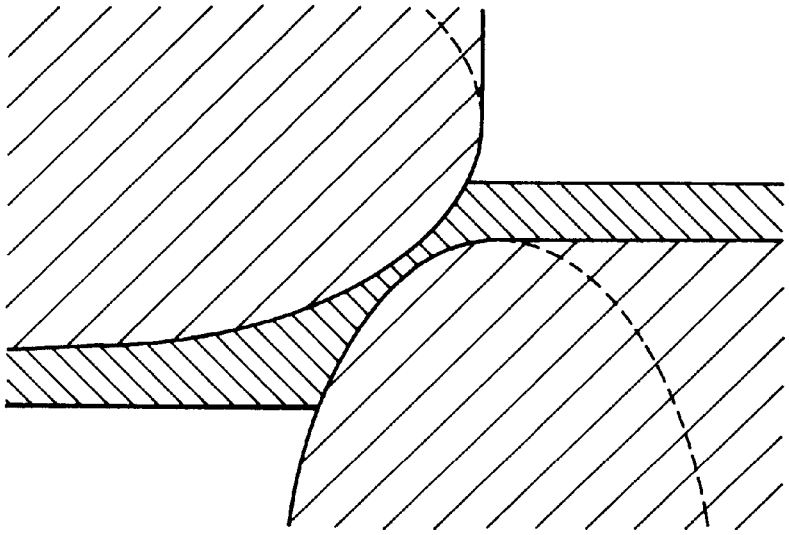
FIG. 15 is a view of the case where the radius of curvature of the ellipse is large.

The dimensions of the ellipse, in the case of a nonlaminated sheet steel, is a long radius $R_A$ of 0.1 to 0.5 mm and a short radius $R_B$ of 0.05 to 4.0 mm. This is because if the radius of curvature of the molds is smaller than 0.05 mm, the thinned length in the cross-section will be short, and therefore, it will be difficult to bend the sheet as shown in FIG. 11, so $R_B\geqq0.05$ mm (FIG. 14). If the radius of curvature of the molds is large, then as shown in FIG. 15 the thinned length in the cross-section will become long, thus the pushed back portion will also become long and the stroke of can opening will become large, therefore the long radius of the ellipse $R_A$ is made$\leqq$5.0 mm. Here, the stroke of can opening means the amount of push-back until breakage. The larger the value, the worse the can openability.

In a nonlaminated aluminum sheet, considering the fact that the minimum residual thickness is greater than that of sheet steel, if the radius of curvature of the molds becomes smaller than 0.1 mm, then it becomes difficult to bend the sheet as shown in FIG. 11, so $R_B$ is preferably at least 0.1 mm. Regarding the upper limit of the radius of the mold, it may be made the same value as the sheet steel since the residual thickness has no effect. Accordingly, the recommended dimensions of the ellipse are a long radius $R_A$ of 0.2 to 5.0 mm and a short radius $R_B$ of 0.1 to 4.0 mm.

On the other hand, in a laminated material, the long radius $R_A$ is made 0.2 to 5.0 mm and the short radius $R_B$ 0.1 to 4.0 mm. This is because with an $R_B$ of less than 0.1, the coating on the surface of the metal sheet will be damaged, so the short radius $R_B$ of the ellipse is made at least 0.1. For the long radius, for the same reasons as a nonlaminated material, $R_A$ is made less than 0.5 mm. The same holds true for sheet steel and aluminum sheet.

Figure 16:
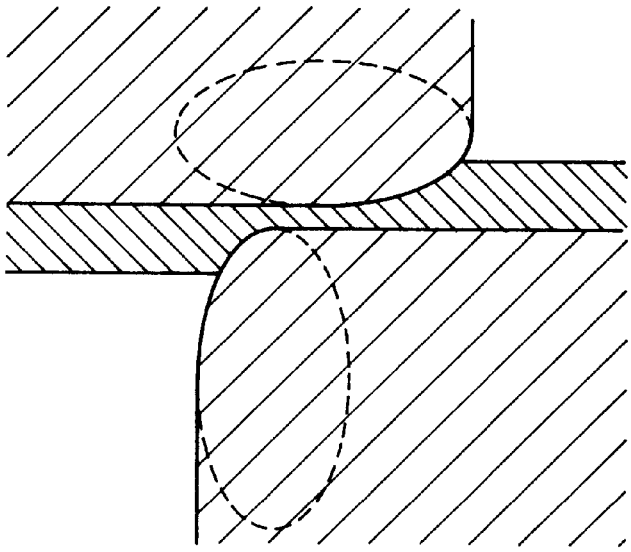
FIG. 16 is a view of the case where the clearance of the upper and lower mold halves is small.
Figure 17:
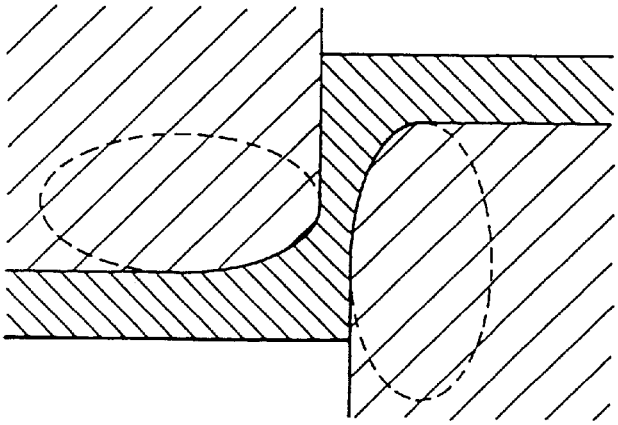
FIG. 17 is a view of the case where the clearance of the upper and lower mold halves is large.
Figure 18:
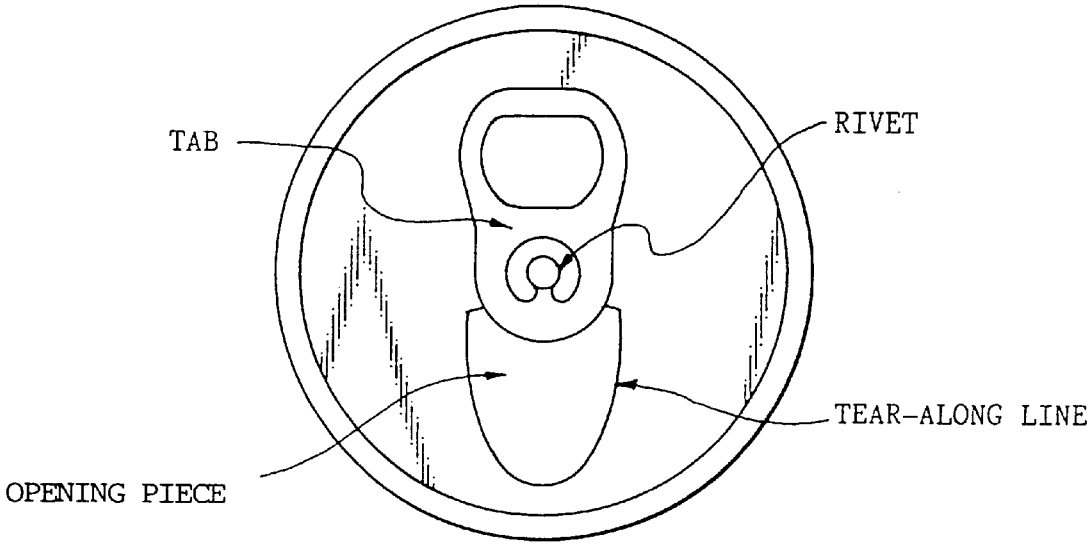
FIG. 18 is a schematic view of an easy open can lid.
Figure 19:
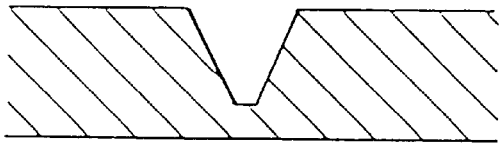
FIG. 19 is a view of the sectional shape of an opening guide groove formed by scoring.

By performing the pressing giving a certain clearance CL to the punch and die formed as explained above, a thinnest portion is formed with the eccentric residual thickness shown in FIG. 13. Here, the clearance CL is represented by $f \times R_B$ using the multiple f of the short radius $R_B$ of the ellipse. For a nonlaminated sheet steel, f is preferably −3.0 to 0.3. Here, a negative clearance means the punch and die overlap. When fi is smaller than −3.0, the punch and the die largely overlap and the angle of the portion thinned becomes lateral as shown in FIG. 16, so push-back processing is not performed well. Further, if f is larger than 0.3, the punch and die are separated from each other, so thinning becomes difficult as shown in FIG. 17.

For a nonlaminated material of aluminum, f is made −3.0 to 0.5. The upper limit for f is set for the same reason as with sheet steel, but in aluminum's case, considering the fact that the minimum residual thickness is smaller than with sheet steel, f is made less than 0.5.

For laminated material, if the clearance f is made greater than 0, the resin film of the surface of the metal sheet may be damaged at the time of thinning, so f is made −3.0 to 0. The same is true for sheet steel and aluminum sheet.

After this thinning, the push-back processing is performed from the top and bottom so as to form the pushed back shape bent at the thinnest portion shown in FIG. 11 and form an easy open can lid with good can openability.

EXAMPLES

The present invention will be explained in further detail in accordance with examples. The present invention is not of course limited to these Examples.

Example 1 and Comparative Example 1

Table 1-1 shows the chemical composition of the materials used for the lids. Steel Type 1 is an extremely low carbon steel, Steel Type 2 is a low carbon steel, and Steel Type 3 is a medium carbon steel—all representative types. The thickness used was 0.2 mm. Electro tin plating was performed to a deposition of 2 to 3 g/m$^2$ on the lid use sheet steel, then the tin was made to reflow and then chromate treatment was applied. The sheet steel was again heated and then the resin film shown in Table 1-2 was laminated on the two surfaces. Table 1-3 shows the steel types, the composition of the resins, the total elongation, the radius of the shoulders of the die and punch, the amount of clearance between the punch and the die, the residual thickness of the tear-along groove of the opening piece, the amount of push-back, the QTV value, showing the process of breaking of the resin film, and the can opening force. Here, the "t" shown in the push-back amount means the step difference of the lid body and opening portion caused at the time of the initial processing. Further, the QTV value enables judgement of the films which will not break after the lid is immersed in saline containing a surfactant and a voltage of 6 V is applied for 1 minute and a current of not more than 1 mA runs. The can opening force is found by measuring the maximum force when opening a stay-on lid type of can. A negative amount of clearance means that the die and the punch partially overlap. The indication of "x" in the column of the can opening force in the table means that the can could not be opened. The elongation of the resin was measured after peeling it off after laminating.

TABLE 1-1

(Unit: %)

| Steel type | C | Si | Mn | P | S | Al | N |
|---|---|---|---|---|---|---|---|
| 1 | 0.0020 | 0.01 | 0.16 | 0.008 | 0.010 | 0.036 | 0.0033 |
| 2 | 0.032 | 0.02 | 0.22 | 0.011 | 0.011 | 0.058 | 0.0023 |
| 3 | 0.123 | 0.02 | 0.25 | 0.012 | 0.008 | 0.062 | 0.0040 |

TABLE 1-2

| | Upper layer | | Lower layer | | Upper and lower | Range of present |
|---|---|---|---|---|---|---|
| Code | Type of resin | Thickness (μm) | Type of resin | Thickness (μm) | layer thickness (μm) | invention (inside: o, outside: x) |
| A | Polyester | 17 | Low melting point polyester containing ionomer | 3 | 20 | o |
| B | Nylon 6 | 50 | Polypropylene and polyethylene copolymer | 20 | 70 | o |
| C | Polyester | 30 | Low melting point polyester | 20 | 50 | o |
| D | Polyester | 100 | Low melting point polyester | 20 | 120 | x |
| E | Polyester | 5 | Low melting point polyester | 3 | 8 | x |

TABLE 1-3

| No. | Steel type | Type of resin | Elongation of resin (%) | Radius of shoulder of die (mm) | Radius of shoulder of punch (mm) | Clearance (mm) | Min. res. thickness of guide groove (μm) | Push-back am't (t) | Q + V (mA) | Can opening force (N) | Range of invention (inside: ○, outside: x) | Remarks |
|---|---|---|---|---|---|---|---|---|---|---|---|---|
| 1 | 2 | C | 316 | 0.5 | 0.5 | −0.5 | 45 | 0.95 | 0.2 | 12 | ○ | Inv. |
| 2 | 2 | C | 316 | 0.5 | 0.5 | −1.0 | 48 | 0.95 | 0.3 | 13 | ○ | Inv. |
| 3 | 2 | C | 316 | 0.5 | 0.5 | −1.5 | 52 | 0.95 | 0.3 | 13 | ○ | Inv. |
| 4 | 2 | C | 316 | 0.5 | 0.5 | −2.0 | 53 | 0.95 | 8.6 | 12 | x | Co. |
| 5 | 2 | C | 316 | 0.5 | 0.5 | 0 | 48 | 0.95 | 0.2 | 12 | ○ | Inv. |
| 6 | 2 | C | 316 | 0.5 | 0.5 | 0.2 | 42 | 0.95 | 0.3 | 12 | ○ | Inv. |
| 7 | 2 | C | 316 | 0.5 | 0.5 | 0.5 | x | 0.95 | — | — | x | Co. |

TABLE 1-3-continued

| No. | Steel type | Type of resin | Elongation of resin (%) | Radius of shoulder of die (mm) | Radius of shoulder of punch (mm) | Clearance (mm) | Min. res. thickness of guide groove (μm) | Push-back am't (t) | Q + V (mA) | Can opening force (N) | Range of invention (inside: ○, outside: x) | Remarks |
|---|---|---|---|---|---|---|---|---|---|---|---|---|
| 8 | 2 | C | 316 | 0.5 | 0.5 | −0.5 | 68 | 0.95 | 0.2 | 17 | ○ | Inv. |
| 9 | 2 | C | 316 | 0.5 | 0.5 | −0.5 | 87 | 0.95 | 0.3 | 19 | ○ | Inv. |
| 10 | 2 | C | 316 | 0.5 | 0.5 | −0.5 | 107 | 0.95 | 0.2 | x | x | Co. |
| 11 | 2 | C | 316 | 0.5 | 0.5 | −0.5 | 46 | 0.45 | 0.2 | 17 | ○ | Inv. |
| 12 | 2 | C | 316 | 0.5 | 0.5 | −0.5 | 45 | 0.20 | 0.4 | x | x | Co. |
| 13 | 2 | C | 316 | 0.5 | 0.5 | −0.5 | 48 | 1.23 | 0.2 | 13 | ○ | Inv. |
| 14 | 2 | C | 316 | 0.5 | 0.5 | −0.5 | 52 | 1.62 | 7.93 | 3 | x | Co. |
| 15 | 2 | C | 316 | 0.2 | 0.2 | −0.5 | 49 | 0.95 | 0.2 | 13 | ○ | Inv. |
| 16 | 2 | C | 316 | 0.05 | 0.05 | −0.5 | 55 | 0.95 | 18.2 | 12 | x | Co. |
| 17 | 2 | C | 316 | 1.0 | 1.0 | −0.5 | 52 | 0.95 | 0.4 | 14 | ○ | Inv. |
| 18 | 2 | C | 316 | 1.5 | 1.5 | −0.5 | 50 | 0.95 | 0.3 | 16 | ○ | Inv. |
| 19 | 2 | C | 316 | 2.0 | 2.0 | −0.5 | 50 | 0.95 | 6.3 | 18 | x | Co. |
| 20 | 1 | B | 220 | 0.5 | 0.5 | −0.5 | 49 | 0.95 | 0.2 | 11 | ○ | Inv. |
| 21 | 3 | A | 125 | 0.5 | 0.5 | −0.5 | 53 | 0.95 | 0.3 | 16 | ○ | Inv. |
| 22 | 2 | D | 360 | 0.5 | 0.5 | −0.5 | 48 | 0.95 | 0.2 | x | x | Co. |
| 23 | 2 | E | 275 | 0.5 | 0.5 | −0.5 | 50 | 0.95 | 12.6 | 12 | x | Co. |
| 24 | 2 | C | 316 | 0.5 | 0.5 | −0.5 | 45 | 0.95 | 0.2 | 11 | ○ | Inv. |

Note:
"Inv:" indicates present invention, while "Co." indicates comparative example.

In Experiment Nos. 1, 2, 3, 5, 6, 8, 9, 11, 13, 15, 17, 18, 20, 21, and 24 satisfy the present invention, the QTV values were all less than 1 mA, there was no breakage of the coatings, and the can opening force was less than 20 N enabling easy manual opening of the can, it was confirmed. Further, in Experiment No. 4 where the clearance was larger than the range of the present invention in the minus side, the compressive stress on the resin film was too large and the resin broke. In Experiment No. 7 where the clearance was larger on the plus side, breakage occurred before the thickness of the guide groove was made less than 100 μm at the initial processing. In Experiment No. 10, where the minimum thickness of the guide groove was more than 100 μm, with the stay-on type of can opening method, the tab ended up flat and the can could not be opened. Further, in Experiment No. 12, where the amount of push-back was small, the can could similarly not be opened. Conversely, in Experiment No. 14 where the amount of push-back was too large, breakage occured at the guide groove at the time of the push-back processing.

In Experiment No. 16, where the radius of the shoulders of the die and punch was smaller than the range of the present invention, the film was broken and a high QTV value was shown. Further, in Experiment No. 19 where the radius of the shoulder was conversely too large, a tremendous compressive stress was required for reducing the residual thickness of the guide groove, so the film was damaged. In Experiment No. 22, where the resin film was thick, in the stay-on type of can opening method, the tab ended up flat and the can could not be opened. Further, in Experiment No. 23, where the resin film was thinner than the range of the present invention, the resin broke at the time of processing the guide groove. Experiment No. 24 was one in which the bead of the opening portion was used to prevent shifting of the opening piece in the horizontal direction with respect to the punch. In this case, the can opening force can be somewhat lowered since the shape of the guide groove becomes uniform.

Example 2 and Comparative Example 2

The surface treated sheet steels used are shown in Table 2-1. The thicknesses and elongations at break of the resin films laminated on the surface treated sheet steels are shown in Table 2-2 and Table 2-3. Further, the easy open can lids were fabricated by processing of the surface treated sheet steel based on the above pressing or push-back processing. The types of the fabricated easy open can lids, the thicknesses of the thinnest portions after processing, the cross-sectional shapes (FIG. 8 and FIGS. 9(A) and 9(B)), and the results of the evaluation are shown in Table 2-2 and Table 2-3.

For the evaluation, the soundness of the coating, the seam property, the can openability, and the dropping strength were examined.

Note that the soundness of the coating was evaluated by a conductance test. The seam property was evaluated by visually observing the state of feathering of the outer surface film of the easy open can lid at the time of fastening the easy open can lid to the can body. The can openability was judged by whether or not the can could be open fully without problem and by measuring the can opening force. The dropping strength was evaluated by preparing a can with an easy open can lid filled with some material, dropping it five times vertically from a height of 60 cm, and examining if the content leaked from the easy open can lid due to the shock of the drop.

TABLE 2-1

| No. | Name | Thickness (mm) | Hardness ($H_{R30T}$) | Apparent weight: Hydrated Cr oxide *1 (mg/m²) | Apparent weight: Metallic Cr (mg/m²) | Sn (mg/m²) | Ni (mg/m²) |
|---|---|---|---|---|---|---|---|
| 1 | TFS chrome-chromate treated sheet steel | 0.255 | 64 | 15 | 100 | — | — |
| 2 | ET electro tin plated | 0.18 | 59 | 12 | 12 | 1.1 | — |

TABLE 2-1-continued

| No. | Name | Thickness (mm) | Hardness ($H_{R30T}$) | Apparent weight: Hydrated Cr oxide *1 (mg/m²) | Apparent weight: Metallic Cr (mg/m²) | Sn (mg/m²) | Ni (mg/m²) |
|---|---|---|---|---|---|---|---|
| | sheet steel | | | | | | |
| 3 | CL Ni base, thin Sn plated sheet steel | 0.20 | 54 | 25 | 15 | 1050 | 20 |
| 4 | TFS chrome-chromate treated sheet steel | 0.190 | 59 | 15 | 100 | — | — |
| 5 | TFS chrome-chromate treated sheet steel | 0.150 | 54 | 15 | 100 | — | — |

TABLE 2-1-continued

| No. | Name | Thickness (mm) | Hardness ($H_{R30T}$) | Apparent weight: Hydrated Cr oxide *1 (mg/m²) | Apparent weight: Metallic Cr (mg/m²) | Sn (mg/m²) | Ni (mg/m²) |
|---|---|---|---|---|---|---|---|
| 6 | ET electro tin plated sheet steel | 0.13 | 54 | 12 | 12 | 1.1 | — |
| 7 | CL Ni base, thin Sn plated sheet steel | 0.20 | 51 | 25 | 15 | 1050 | 20 |
| 8 | TFS chrome-chromate treated sheet steel | 0.100 | 63 | 15 | 100 | — | — |

*1 Amount of hydrated Cr oxide shown as amount of Cr.

TABLE 2-2

| No. | Base material | Resin film properties: Inside surface polyester: Film thickness (μm) | Inside surface polyester: Elongation at break (%) | Outside surface: Resin film | Outside surface: Film thickness (μm) | Lid shape: Type of easy open can lid | Lid shape: Thickness of steel sheet at thinnest portion (μm) | Lid shape: Push-back sectional shape (FIG.) | Evaluation of performance: Soundness of inner surface film | Evaluation of performance: Conductance of inner surface (mA) | Evaluation of performance: Can openability | Evaluation of performance: Seamability | Evaluation of performance: Dropping strength |
|---|---|---|---|---|---|---|---|---|---|---|---|---|---|
| 1*1 | 1 | 40 | 229 | Nylon 6 | 40 | FIG. 7A | 55 | 9A | EG | 0.2 | EG | EG | EG |
| 2*1 | 2 | 15 | 170 | Nylon 12 | 15 | | 75 | 9A | G | 0.8 | G | EG | EG |
| 3*1 | 3 | 75 | 190 | Nylon 66 | 60 | stay | 40 | 9A | EG | 0.1 | EG | EG | EG |
| 4*1 | 4 | 40 | 200 | Polyester | 40 | on | 55 | 9B | EG | 0.2 | EG | G | EG |
| 5*2 | 1 | 8 | 180 | Nylon 6 | 40 | type | 40 | 9A | P | 7.8 | EG | EG | EG |
| 6*2 | 1 | 40 | 90 | Nylon 6 | 40 | | 110 | 9A | P | 10.5 | P | EG | EG |
| 7*2 | 1 | 40 | 180 | Nylon 6 | 40 | | 10 | 9A | G | 0.5 | EG | EG | P |
| 8*2 | 1 | 40 | 180 | Nylon 6 | 40 | | 40 | 8 | EG | 0.2 | P | EG | EG |
| 9*1 | 1 | 30 | 220 | Nylon 6 | 30 | FIG. 7B | 65 | 9A | EG | 0.1 | EG | EG | EG |
| 10*1 | 2 | 15 | 170 | Nylon 12 | 15 | | 95 | 9A | G | 0.5 | G | EG | EG |
| 11*1 | 3 | 75 | 190 | Nylon 66 | 45 | | 35 | 9A | EG | 0.2 | EG | EG | G |
| 12*1 | 4 | 40 | 200 | Polyester | 40 | | 55 | 9B | EG | 0.2 | EG | G | EG |
| 13*2 | 1 | 8 | 180 | Nylon 6 | 40 | | 55 | 9A | P | 4.7 | EG | EG | EG |
| 14*2 | 1 | 40 | 185 | Nylon 6 | 40 | | 110 | 9A | P | 15.5 | P | EG | EG |
| 15*2 | 1 | 40 | 180 | Polyester | 40 | | 10 | 9A | G | 0.8 | EG | EG | P |
| 16*2 | 1 | 40 | 180 | Nylon 6 | 40 | | 55 | 8 | EG | 0.3 | P | EG | EG |

*1: Example
*2: Comparative Example
Note)
Underlines indicate out of invention.
Evaluation of performance:
EG: extremely good,
G: good,
P: poor (not practical).

TABLE 2-3

| | | Resin film properties | | | | Lid shape | | | Evaluation of performance | | | | |
|---|---|---|---|---|---|---|---|---|---|---|---|---|---|
| | | Inside surface polyester | | Outside surface | | | | | | | | | |
| No. | Base material | Film thickness (μm) | Elongation at break (%) | Resin film | Film thickness (μm) | Type of easy open can lid | Thickness of steel sheet at thinnest portion (μm) | Push-back sectional shape (FIG.) | Soundness of inner surface film | Conductance of inner surface (mA) | Can openability | Seamability | Dropping strength |
| 17*1 | 5 | 40 | 220 | Nylon 6 | 40 | FIG. | 40 | 9A | EG | 0.2 | EG | EG | EG |
| 18*1 | 6 | 15 | 170 | Nylon 12 | 16 | 7C | 35 | 9A | G | 0.3 | EG | EG | EG |
| 19*1 | 7 | 75 | 190 | Nylon 66 | 60 | | 20 | 9A | EG | 0.1 | EG | EG | G |
| 20*1 | 8 | 40 | 200 | Polyester | 40 | | 45 | 9B | EG | 0.2 | EG | G | EG |
| 21*2 | 5 | 8 | 180 | Nylon 6 | 40 | | 40 | 9A | P | 7.3 | EG | EG | EG |
| 22*2 | 5 | 40 | 90 | Nylon 6 | 40 | | 110 | 9A | P | 10.5 | P | EG | EG |
| 23*2 | 5 | 40 | 180 | Nylon 6 | 40 | FIG. 7B | 10 | 9A | G | 0.8 | EG | EG | P |
| 24*2 | 5 | 40 | 180 | Nylon 6 | 40 | C | 40 | 8 | EG | 0.2 | P | EG | EG |

*1: Example
*2: Comparative Example
Note)
Underlines indicate out of invention.
Evaluation of performance:
EG: extremely good,
G: good,
P: poor (not practical).

Example 3 and Comparative Example 3

The specifications of the metal sheets used are shown in Table 3-1 and Table 3-3.

The evaluations of the eccentricity of the easy open can lids, the minimum thicknesses, the can openability, and the soundness of the films formed by the thinning and then push-back processing changing the conditions of the pressing for nonlaminated and laminated materials are shown in Table 3-2 and Table 3-4. The can openability is evaluated from the push-down can opening load and amount of push in up to when the can is opened. The soundness of the film is evaluated by the lack of breakage of the film when a current of less than 1 mA is passed by passing a current to the resin film.

TABLE 3-1

Specifications of Laminated Sheet Steel Used in Experiments (Nonlaminated Materials Only Underlying Base Materials)

| | Name | Material | Thickness before processing |
|---|---|---|---|
| Laminated sheet steel | Upper layer resin film | PET | 40 μm |
| | Base material | Tin free steel T-2.5 | 190 μm |
| | Lower layer resin film | PET | 40 μm |

TABLE 3-2

Experimental Findings (Base Material: Sheet Steel)

| No. | Presence of film | Shape of mold $R_A$ | $R_B$ | f*1 | CL*2 | Angle φ of upper and lower mold halves | Eccentricity ρ (%) | Min. residual thickness (μm) | Can openability | Film soundness | Remark |
|---|---|---|---|---|---|---|---|---|---|---|---|
| 1 | Nonlam. | 1.0 | 0.5 | −0.1 | −0.05 | 90 | 6 | 45 | G | — | Inv. |
| 2 | Laminated | 1.5 | 0.5 | −0.8 | −0.4 | 90 | 35 | 55 | G | G | Inv. |
| 3 | Laminated | 1.0 | 0.5 | −1 | −0.5 | 90 | 15 | 75 | G | EG | Inv. |
| 4 | Nonlam. | 1.0 | 0.5 | −0.8 | −0.4 | 45 | 12 | 47 | G | — | Inv. |
| 5 | Laminated | 1.0 | 0.5 | −1 | −0.5 | 120 | 15 | 51 | G | EG | Inv. |
| 6 | Nonlam. | 0.2 | 0.1 | −1 | −0.5 | 90 | 13 | 45 | EG | — | Inv. |
| 7 | Laminated | 0.7 | 0.3 | −1 | −0.3 | 90 | 14 | 56 | EG | G | Inv. |
| 8 | Laminated | 1.0 | 0.5 | −1 | −0.5 | 90 | 15 | 40 | EG | EG | Inv. |
| 9 | Nonlam. | 1.2 | 0.5 | −0.8 | −0.4 | 90 | 25 | 62 | EG | — | Inv. |
| 10 | Nonlam. | 3.0 | 1.5 | −1 | −1.5 | 90 | 18 | 56 | G | — | Inv. |
| 11 | Laminated | 0.4 | 0.2 | −1 | −1.0 | 90 | 14 | 52 | EG | G | Inv. |
| 12 | Nonlam. | 1.2 | 0.5 | −1.2 | −0.7 | 90 | 12 | 61 | EG | — | Inv. |
| 13 | Nonlam. | 1.0 | 0.5 | 0 | 0 | 90 | 8 | 45 | G | — | Inv. |
| 14 | Laminated | 1.0 | 0.5 | −0.3 | −0.15 | 90 | 10 | 54 | G | G | Inv. |
| 15 | Laminated | 1.0 | 0.5 | −2.5 | −0.75 | 90 | 5 | 56 | G | G | Inv. |
| 16 | Laminated | 2.0 | 0.5 | −0.8 | −0.4 | 90 | 45 | 57 | P | G | Comp. |

TABLE 3-2-continued

Experimental Findings (Base Material: Sheet Steel)

| No. | Presence of film | Shape of mold $R_A$ | $R_B$ | f*1 | CL*2 | Angle ϕ of upper and lower mold halves | Eccentricity ρ (%) | Min. residual thickness (μm) | Can openability | Film soundness | Remark |
|---|---|---|---|---|---|---|---|---|---|---|---|
| 17 | Nonlam. | 1.0 | 0.5 | −1 | −0.5 | 90 | 11 | 90 | P | — | Comp. |
| 18 | Nonlam. | 0.02 | 0.01 | −1 | −0.01 | 90 | 14 | 46 | P | — | Comp. |
| 19 | Nonlam. | 6.0 | 3.0 | −1 | −3.0 | 90 | 22 | 45 | P | — | Comp. |
| 20 | Laminated | 0.1 | 0.05 | −1 | −0.05 | 90 | 14 | 56 | G | P | Comp. |
| 21 | Laminated | 6.0 | 3.0 | −1 | −3.0 | 90 | 22 | 51 | P | P | Comp. |
| 22 | Nonlam. | 1.0 | 0.5 | 0.7 | 0.35 | 90 | 0 | (20) | P | — | Comp. |
| 23 | Laminated | 1.6 | 0.8 | 0.4 | 0.32 | 90 | 3 | 41 | P | P | Comp. |
| 24 | Laminated | 1.0 | 0.5 | −3.5 | −1.75 | 90 | — | 45 | P | P | Comp. |

*1,2: Provided, however, that clearance is expressed by f, CL using CL = f × $R_8$.
Evaluations:
EG: extremely good,
G: good,
P: poor (not practical).

TABLE 3-3

Specifications of Laminated Aluminum Sheet Used in Experiments (Nonlaminated Materials Only Underlying Base Materials)

| | Name | Material | Thickness before processing |
|---|---|---|---|
| Laminated sheet | Upper layer resin film | PET | 40 μm |
| | Base material | 5052 H38 | 250 μm |
| | Lower layer resin film | PET | 40 μm |

TABLE 3-4

Experimental Findings (Base Material: Aluminum Sheet)

| No. | Presence of film | Shape of mold $R_A$ | $R_B$ | f*1 | CL*2 | Angle ϕ of upper and lower mold halves | Eccentricity ρ (%) | Min. residual thickness (μm) | Can openability | Film soundness | Remark |
|---|---|---|---|---|---|---|---|---|---|---|---|
| 1 | Nonlam. | 1.0 | 0.5 | −0.1 | −0.05 | 90 | 6 | 96 | G | — | Inv. |
| 2 | Laminated | 1.5 | 0.5 | −0.8 | −0.4 | 90 | 35 | 116 | G | G | Inv. |
| 3 | Laminated | 1.0 | 0.5 | −1 | −0.5 | 90 | 15 | 179 | G | EG | Inv. |
| 4 | Laminated | 1.0 | 0.5 | −1 | −0.5 | 120 | 15 | 124 | G | EG | GInv. |
| 5 | Nonlam. | 0.2 | 0.1 | −1 | −0.5 | 90 | 13 | 137 | EG | — | Inv. |
| 6 | Laminated | 0.7 | 0.3 | −1 | −0.3 | 90 | 14 | 110 | EG | G | Inv. |
| 7 | Laminated | 1.0 | 0.5 | −1 | −0.5 | 90 | 15 | 121 | EG | EG | Inv. |
| 8 | Nonlam. | 1.2 | 0.5 | −0.8 | −0.4 | 90 | 25 | 89 | EG | — | Inv. |
| 9 | Nonlam. | 3.0 | 1.5 | −1 | −1.5 | 90 | 18 | 108 | G | — | Inv. |
| 10 | Laminated | 0.4 | 0.2 | −1 | −1.0 | 90 | 14 | 128 | EG | G | Inv. |
| 11 | Nonlam. | 1.0 | 0.5 | 0 | 0 | 90 | 8 | 97 | G | — | Inv. |
| 12 | Laminated | 1.0 | 0.5 | −0.3 | −0.15 | 90 | 10 | 102 | G | G | Inv. |
| 13 | Laminated | 1.0 | 0.5 | −2.5 | −0.75 | 90 | 5 | 129 | G | G | Inv. |
| 14 | Laminated | 2.0 | 0.5 | −0.8 | −0.4 | 90 | 45 | 156 | P | G | Comp. |
| 15 | Nonlam. | 1.0 | 0.5 | −1 | −0.5 | 90 | 11 | 237 | P | — | Comp. |
| 16 | Nonlam. | 0.1 | 0.05 | −1 | −0.01 | 90 | 14 | 142 | P | — | Comp. |
| 17 | Nonlam. | 6.0 | 3.0 | −1 | −3.0 | 90 | 22 | 125 | P | – | Comp. |
| 18 | Laminated | 0.1 | 0.05 | −1 | −0.05 | 90 | 14 | 113 | G | P | Comp. |
| 19 | Laminated | 6.0 | 3.0 | −1 | −3.0 | 90 | 22 | 120 | P | P | Comp. |
| 20 | Nonlam. | 1.0 | 0.5 | 1.0 | 0.5 | 90 | 0 | (190) | P | — | Comp. |
| 21 | Laminated | 1.6 | 0.8 | 0.4 | 0.32 | 90 | 3 | 102 | P | P | Comp. |
| 22 | Laminated | 1.0 | 0.5 | −3.5 | −1.75 | 90 | — | 122 | P | P | Comp. |

*1,2: Provided, however, that clearance is expressed by f, CL using CL = f × $R_8$.
Evaluations:
EG: extremely good,
G: good,
P: poor (not practical).

INDUSTRIAL APPLICABILITY

According to the present invention, it becomes possible to improve the short life of scoring blades which had been a problem in the conventional scoring. Further, by using a thermoplastic resin laminated metal sheet as the material, it becomes possible to eliminate damage to the resin film on the surface and obtain a metal easy open can lid not requiring repair coating after processing. Further, by using a thermoplastic resin laminated sheet steel, use of steel for the easy open can lid becomes possible and use of just steel for the can can be realized and therefore low cost production of a product suited for recycling to alleviate the environmental load can be realized.

We claim:

1. A process for producing a resin coated can lid having an opening piece comprising:

providing a steel can lid body having a resin film on both sides, said resin film having a thickness of 10 to 100 μm and an elongation at breakage of at least 100%;

providing a punch and die for pressing said lid body for forming an opening piece, said punch and die each having a pressing shoulder, each pressing shoulder having a radius of 0.1 to 1.6 mm, with clearance between the pressing shoulder of the punch and the pressing shoulder of the die being −1.6 to 0.3 mm;

pressing said lid body with said punch and die to provide said opening piece displaced at a step difference from said lid body, with a residual tear-along groove portion disposed between said lid body and said opening piece, said tear-along groove portion having a minimum thickness of 15 to 100 μm;

push-back processing of said opening piece toward said lid body by displacing said opening piece a distance of 0.3 to 1.5 times said step difference formed by said pressing in a direction opposite to said pressing.

2. A process according to claim 1 further comprising:

forming a bead on said opening piece during formation of said opening piece in said pressing step;

providing a push-back punch having a recess portion for engaging said bead of said opening piece;

engaging said bead of said opening piece with said recess of said push-back punch during push-back processing for preventing horizontal movement of said opening piece during push-back processing.

3. A steel sheet easy open can lid formed by a pressing and a push-back processing method comprising:

a can lid body including an opening piece and a tear-along groove, said tear-along groove being disposed between the can lid body and the opening piece, said can lid body, said opening piece, and said tear-along groove being formed from a single piece of steel sheet;

a side of said can lid body, said opening piece and said tear-along groove corresponding to an inside surface of the can has laminated thereon a saturated polyester resin film having a thickness of 10 to 100 μm and an elongation of at least 100% at breakage;

said tear-along groove having a compressed S-shape cross-section having a thinnest thickness of 15 to 100 μm located at a deepest point of curvature of one curve of the S-shaped cross-section.

4. A steel sheet easy open can lid according to claim 3, wherein a side of the can lid body, the opening piece, and the tear-along groove corresponding to an outside surface of the can has laminated thereon a polyamide resin having a thickness of 10 to 100 μm.

5. A steel sheet easy open can lid according to claim 3 further comprising:

said opening piece has attached thereto a tab for removing said opening piece from said can lid; and said opening piece comprises one of a portion of the can lid and substantially all of the can lid.

6. A steel sheet easy open can lid according to claim 3 further comprising:

said opening piece does not have attached thereto a tab for removing said opening piece from said can lid; and said opening piece comprises one of a portion of the can lid and substantially all of the can lid.

7. A process for producing a metal sheet easy open can lid comprising:

providing a piece of metal sheet for forming the metal sheet easy open can lid;

pressing the piece of metal sheet between a punch and a die forming a thinned processed portion disposed between an unthinned non-processed portion corresponding to a can lid body and an unthinned non-processed portion corresponding to an opening piece;

said thinned processed portion having a length with a center;

said pressing resulting in a thinnest cross-sectional area of said thinned processed portion being displaced 3 to 40% of the length of said thinned processed portion from the center of the length of said thinned processed portion;

forming a tear-along groove between said can lid body non-processed portion and said opening piece non-processed portion by push-back processing in a direction opposite to pressing to bend said thinned processed portion at said displaced thinnest cross-sectional area.

8. A process for producing a metal sheet easy open can lid according to claim 7 further comprising:

providing said punch with a shoulder and providing said die with a shoulder, with the shoulder of each of the punch and the die having a form of part of a ellipse having a long radius of 0.1 to 5.0 mm and a short radius of 0.05 to 4.0 mm, with an angle of 30 to 150 degrees formed by the long radius of the ellipse of each of the punch and the die shoulders; and providing a clearance between the punch shoulder and the die shoulder of −3.0 to 0.5 times the short radius of the ellipse.

9. A process for producing a metal sheet easy open can lid comprising:

providing a piece of metal sheet for forming the metal sheet easy open can lid, said piece of metal having on at least a side corresponding to an inside surface of the can at least one of a coating and a resin film having a thickness of 10 to 100 μm and a elongation at breakage of at least 100%;

pressing the piece of metal sheet between a punch and a die forming a thinned processed portion disposed between an unthinned non-processed portion corresponding to a can lid body and an unthinned non-processed portion corresponding to an opening piece;

said thinned processed portion having a length with a center;

said pressing resulting in a thinnest cross-sectional area of said thinned processed portion being displaced 3 to 40% of the length of said thinned processed portion from the center of the length of said thinned processed portion;

forming a tear-along groove between said can lid body non-processed portion and said opening piece non-processed portion by push-back processing in a direction opposite to pressing to bend said thinned processed portion at said displaced thinnest cross-sectional area.

10. A process for producing a metal sheet easy open can lid according to claim 9 further comprising:

providing said punch with a shoulder and providing said die with a shoulder, with the shoulder of each of the punch and the die having a form of part of an ellipse having a long radius of 0.2 to 5.0 mm and a short radius of 0.1 to 4.0 mm, with an angle of 30 to 150 degrees formed by the long radius of the ellipse of each of the punch and the die shoulders; and providing a clearance between the punch shoulder and the die shoulder of −3.0 to 0 times the short radius of the ellipse.

11. A metal sheet easy open can lid formed from a pressing and push-back processing method comprising:

a can lid body, an opening piece, and a tear-along groove, said tear-along groove being disposed between the can lid body and the opening piece; the can lid body, the opening piece, and the tear-along groove all being formed from a single piece of metal sheet;

at least one of a coating and a resin film having a thickness of 10 $\mu$m to 100 $\mu$m and an elongation at breakage of at least 100% disposed on at least a side of said can lid body, said opening piece and said tear-along groove corresponding to an inside surface of the can;

said tear-along groove having a compressed S-shaped cross-section;

said tear-along groove being a pressed processed portion of said single piece of metal sheet and said can lid body and said opening piece being a non-pressed process portion of said single piece of said metal sheet, with said tear-along groove pressed process portion having a cross-sectional thickness thinner than a cross-sectional thickness of said non-pressed process portions of said can lid body and said opening piece;

said tear-along groove pressed process portion having a thinnest cross-sectional thickness at a distance of 3 to 40% of a length of the pressed process portion displaced from a center of the length of the pressed process portion prior to bending, with said thinnest cross-sectional thickness located at one bend of said compressed S-shape cross-section after bending into said compressed S-shaped cross-section of said tear-along groove.

* * * * *